US005729859A

United States Patent [19]

Guffin, III

[11] Patent Number: 5,729,859

[45] Date of Patent: Mar. 24, 1998

[54] GUM AND TOOTHBRUSH FOR USE BY INFANTS AND SMALL CHILDREN

[76] Inventor: George E. Guffin, III, 4315 Wedgewood St., Jackson, Miss. 39211

[21] Appl. No.: 746,011

[22] Filed: Nov. 5, 1996

[51] Int. Cl.[6] ..... A46B 9/04

[52] U.S. Cl. ..... 15/167.1; 606/235; D4/105

[58] Field of Search ..... 15/110, 167.1, 15/167.2; 119/709, 710; 132/321, 329; 128/859, 860, 861; 606/234, 235, 236; D4/104, 105, 106, 111, 119, 120, 127; D24/193, 194

[56] References Cited

U.S. PATENT DOCUMENTS

| | | | |
|---|---|---|---|
| D. 99,485 | 4/1936 | Weber | D4/127 |
| 860,527 | 7/1907 | Cochrane | 15/167.1 |
| 878,486 | 2/1908 | Crowell . | |
| 2,121,358 | 6/1938 | Loeffler . | |
| 2,140,294 | 12/1938 | Loeffler | 15/167.2 |
| 2,208,013 | 7/1940 | Baker | 15/167.1 |
| 2,511,235 | 6/1950 | Arwood . | |
| 3,163,874 | 1/1965 | Bauer . | |
| 3,720,975 | 3/1973 | Nelson | 15/167.1 |
| 4,625,357 | 12/1986 | Demartino . | |
| 4,654,921 | 4/1987 | Dinner . | |
| 4,888,844 | 12/1989 | Maggs . | |
| 5,048,143 | 9/1991 | Carroll . | |
| 5,291,878 | 3/1994 | Lombardo et al. . | |
| 5,615,443 | 4/1997 | Lai | 15/167.2 |

FOREIGN PATENT DOCUMENTS

| | | | |
|---|---|---|---|
| 0012516 | of 1897 | United Kingdom | 15/167.2 |
| 8403209 | 8/1984 | WIPO | 15/167.1 |

*Primary Examiner*—Randall Chin

*Attorney, Agent, or Firm*—Pravel, Hewitt, Kimball & Krieger

[57] ABSTRACT

A gum and toothbrush apparatus for an infant provides a body with a proximal end portion and a distal end portion. The distal end portion includes opposed layers of bristles for brushing the infant's upper and lower gums and teeth. The body has a proximal end hemispherically shaped with a handle that can be gripped and manipulated by the child. A guard or gauge is positioned in between the proximal and distal ends. The guard is concavely shaped to register against the infant's mouth adjacent to the lips. Further, the guard is sized and shaped to conform generally to the child's lips and adjacent mouth, but being too large to be placed inside the infant's mouth. The concavity of the gauge aligns the bristles with the infant's gum ridge line when the concavity abuts the infant's lips. The body handle, and guard can be of a rubber or soft plastic material.

12 Claims, 1 Drawing Sheet

GUM AND TOOTHBRUSH FOR USE BY INFANTS AND SMALL CHILDREN

BACKGROUND OF THE INVENTION

1. Field of the Invention

The present invention relates to teething devices for infants and small children (ages 6 months to 18 months) and more particularly to an improved teething apparatus that is a combination of a teething device and toothbrush to assist a small child in daily dental hygiene during the time period of tooth development prior to training with a conventional adult toothbrush. Even more particularly the present invention relates to an improved gum and toothbrush apparatus for infants and small children that includes a body member having a gauge or shield to prevent swallowing of the apparatus by the infant, a handle with a low profile that minimizes injury to the infant in the event that he or she falls, and a two-sided bristle brush member shaped to track the gum line of the infant or small child.

2. General Background

Typically a child will visit a dentist at an age of about three years old. Until that first visit, infants and toddlers are susceptible to tooth decay and gum ailments like older children. The hygenic need for brushing one's teeth is uniformly accepted. However, dental care for infants and toddlers can be stressful to them. They can often be uncooperative. Conventional toothbrushes can be unsafe for very small children.

Conventional straight-handle toothbrushes formed to "child proportions" are available which permit plaque to be removed. Such toothbrushes may be effective if used by an adult on the infant's teeth. These brushes present danger of injury to an unsupervised infant or toddler. These brushes can be difficult for a small child to manipulate and thus be ineffective in dental cleaning. If the child is not supervised, straight handle and brush head may be inserted entirely into the mouth of the child possibly getting lodged in the throat or otherwise causing damage to the child's mouth.

A child may utilize the conventional toothbrush unsupervised while walking, playing, or falling. There are other brushes that are designed to prevent the body of the brush from being inserted fully into a child's mouth and causing damage. The brush portion of this design only covers the top or bottom areas of the teeth or gums depending on which side is inserted. This design has no gauge to place the brush into the mouth, leaving areas of the gums and teeth unbrushed.

There is thus a need for a brush that can be placed in the mouth that will be gauged to stop over all gum and tooth areas, at the top and bottom of the mouth.

There is a need for a safe, effective brush that can be used by a child even when unsupervised, for the removal of plaque and food deposits from the gums and teeth of infants and toddlers.

Several baby teething and gum massaging devices have been patented. Other toothbrush designs employ shields or guards.

An early U.S. Pat. (No. 878,486) entitled "TOOTHBRUSH" discloses a toothbrush that has a sanitary shield to prevent the flow of saliva from the head of the toothbrush to the handle.

The Loeffler U.S. Pat. No. 2,121,358 discloses a toothbrush that is curved in conformity with a natural set of teeth. An arcuate guide 23 is slidable upon a stem or shank. In operation, the handle is actuated in a manner to cause the brush tufts to move up and down reciprocatively.

The Arwood U.S. Pat. No. 2,511,235 discloses a toothbrush handle and head construction.

The Bauer patent entitled "TOOTHBRUSH" (U.S. Pat. No. 3,163,874) provides a toothbrush having a handle in a U-shaped frame covered with bristles.

The DeMartino U.S. Pat. No. 4,625,357 provides a toothbrush with a bifurcated forward end. The spaced free outer ends of the bifurcations are interconnected by a transversely extending arched head defining opposite lower side walls and an upper middle wall therebetween. Tufts of bristles project inwardly from the inter wall of the head. The tufts project from the opposite side walls at an angle to the horizontal center line of the head and the tufts projecting in the middle wall point toward the center point of the head.

U.S. Pat. No. 4,654,921 discloses a toothbrush comprised of a handle including an oval ring that defines an oval aperture sized for the passage therethrough for a young child's four fingers. A half portion of the oval ring and a brush head including an array of bristles that extends in general alignment with the major axis of the oval ring.

The Maggs U.S. Pat. No. 4,888,844 discloses a multipurpose toothbrush for cleaning and brushing a person's natural teeth and also his or her dentures. The device comprises an elongated handle for holding same by user. An enlarged bulbous member is provided at one end of the handle. This member has a large number of bristles extending outwardly therefrom. One area of bristles has a substantially flat surface while the rest of the bristles provide a curved surface. Two parallel side edges are provided by the junctions between the flat surface and the curved surface. The very end of the bristle covered member is rounded. The side edges and rounded end are very useful in cleaning dentures.

The Carroll U.S. Pat. No. 5,048,143 discloses a teething brush for an infant or child which as a body in the shape of a closed ring. The body ring has a forward curved portion which is dimensioned to fit within a child's opened mouth and a rearward curved portion which is wider than a child's opened mouth so as to prevent the body from being inserted fully into a child's mouth. The rearward curved portion forms a handle for gripping by a child and has a plurality of protrusions which extend from the upper and lower surfaces of the rearward portion to form teething bumps for biting engagement with a child's teeth and gums. The teething brush has a brush head formed of a plurality of upstanding bristles which extend from the forward curved portion of the body. The brush head is curved to conform to the curve of the forward body portion. The teething brush has smooth sides and rounded edges and is dimensioned to avoid trauma to a child's throat and mouth to permit unsupervised use by infants and small children.

A baby teething gum massager is the subject of U.S. Pat. No. 5,291,878. The baby teething gum massager has a body in the shape of a figure eight with a forward curved portion dimensioned to fit within a child's opened mouth and a rearward curved portion which is wider than a child's mouth. The forward curved portion contains a plurality of tufts of bristles embedded on opposite sides of the forward portion in a conventional manner to provide a large number of contact surfaces and permit flexing of the bristles which the infant bites.

SUMMARY OF THE INVENTION

The present invention is an improvement to the prior art, providing a brush for infants with an improved shape particularly suited for infants and small children ages 6 months to 18 months. A guard prevents swallowing. An improved handle minimizes the chance of injury should the child fall. The guard also functions as a gauge to register the bristles of the brush on the child's upper and lower teeth and gums.

The apparatus has a brush portion in the shape of a general, flat oval disc. The shape of the disc matches the curve of the gums where the teeth protrude and line up in a row from the front of the mouth to the back. The disc or body of the brush is made up of tufted bristles that cover the top and bottom. When placed in the mouth, these bristles will cover the gums and teeth from front to back, top and bottom reaching all areas to be cleaned.

A safety shield or guard provides a gauge for brush placement in the mouth, thus ensuring exact and proper placement of bristles on the teeth and gums. The shield also prevents brush from being overly inserted into the mouth, a condition that could cause damage to the throat and mouth cavity. The button handle on the shield has a low profile thus lessening the chances of any damage to mouth if the child falls on its face or rolls over face down.

It is thus an object of the present invention to provide a child's toothbrush that can be safely used by an infant or toddler without a danger of becoming lodged and/or causing damage to the child's mouth cavity.

It is a further object of the present invention to provide a child's toothbrush which can be used by the child when supervised or when unsupervised.

It is another object of the present invention to provide a child's toothbrush which will effectively remove plaque and food deposits from all of the child's teeth and gum areas.

It is further an object of the present invention to provide a child's toothbrush that will initiate early pre-dental gum and tooth care so that such care will become routine in the daily development of the child's dental health.

The present invention thus provides an improved gum and toothbrush apparatus for use by an infant or small child. The apparatus includes a body having a proximal end and a distal end. The proximal end provides a rounded or shaped handle that can be gripped and manipulated by the child along a peripheral edge.

The body includes a gauge that is positioned in between the proximal and distal ends for automatically defining the distance that the distal end enters into the child's mouth.

The distal end is a planar portion of the brush member that extends longitudinally and transversely, and including a curved peripheral portion. The peripheral portion generally tracks the gum ridge line of the infant's mouth.

The distal end has a brush member that includes an upper layer of bristles that faces and engage the infant's upper gum and a lower layer of bristles that faces and engages the infant's lower gum.

The gauge includes a concavity that helps prevent injury to the infant by registering against the child's face at the lips to thereby limit the distance that the distal end portion can enter the child's mouth.

The concavity of the gauge aligns the bristles with the infant's gum ridge line when the concavity abuts the infant's lips and the handle is centered on the child's face.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
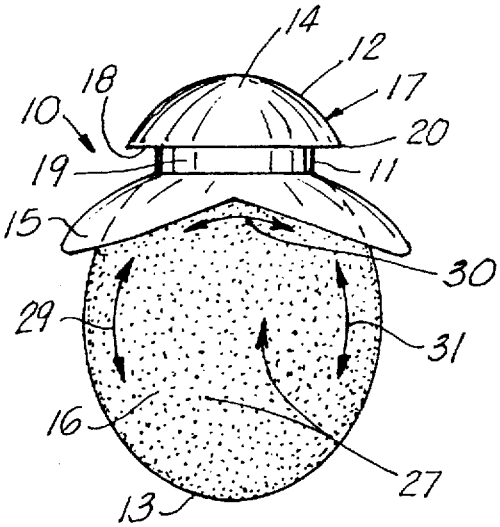
FIG. 1 is a top plan view of the preferred embodiment of the apparatus of the present invention.
Figure 2:
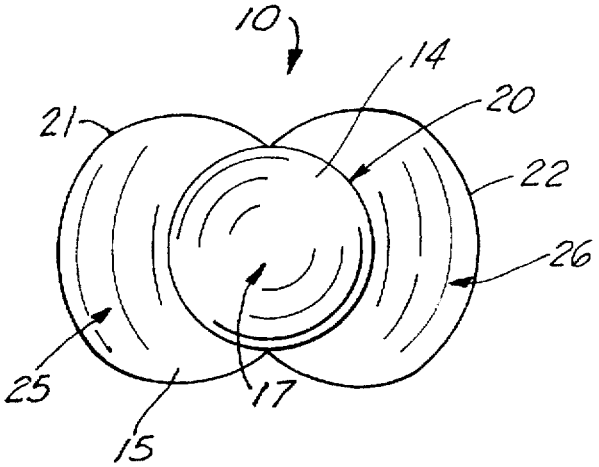
FIG. 2 is an end view showing the proximal end portion of the apparatus of the present invention.
Figure 3:
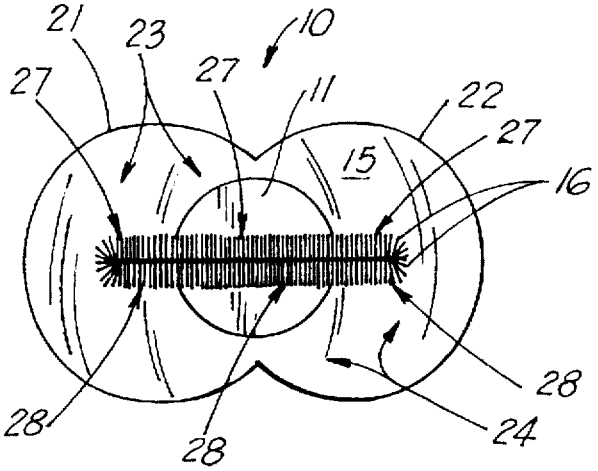
FIG. 3 is an end view showing the distal end portion of the apparatus of the present invention.
Figure 4:
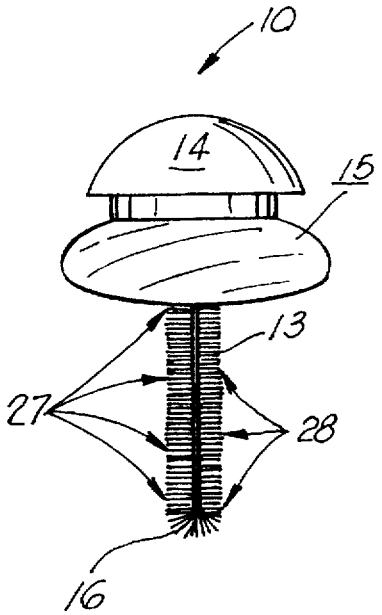
FIG. 4 is a side view of the preferred embodiment of the apparatus of the present invention.

FIGS. 1–4 show generally the preferred embodiment of the apparatus of the present invention designated generally by the numeral 10.

In FIGS. 1–4, gum and toothbrush apparatus 10 includes a body 11 having a proximal end 12 and a distal end 13. The proximal end 12 provides a hemispherically shaped handle 14. The distal end portion 13 provides a brush 16 portion. The central portion of the apparatus 10 in between handle 14 and brush 16 provides guard or gauge 15. Handle 14 provides a generally hemispherical surface 17 that provides a profile that will not cause damage to the child should the child fall face down while the apparatus 10 is within the child's mouth. Further, the hemispherical surface 17 is a generally blunt surface and will present minimal chances of injury to the child whether held, thrown, or the like.

A flat annular shoulder 18 forms an edge 20 with hemispherical surface 17. This edge 20 provides an easy surface for gripping by the child. A cylindrical section 19 of body 11 forms a connection between handle 14 and brush 16. Guard 15 is mounted to cylindrical section 19.

The guard 15 functions as an enlarged member that prevents the child from completely inserting the apparatus 10 into the child's mouth where the distal portion 13 could cause damage to the child's throat. Further, the enlarged guard 15 simply prevents the child from placing the apparatus 10 in his or her mouth so that it can not be swallowed or cut-off the child's air supply. Guard 15 is comprised of a pair of spaced apart circular flange sections 21, 22. Each of the respective circular flange sections 21, 22 provides a concave surface 23 or 24. These concave surfaces 23, 24 face the child's mouth, covering the lips and adjacent area of the child's face when the brush 16 is inside the child's mouth. The circular flange sections 21, 22 also provide respective convex surface portions 25, 26. These surfaces 25, 26 face toward from the handle 14, so that the child can easily grip edge 20 for manipulating and turning the apparatus 10 during use.

Brush 16 includes a flat member such as distal end 13 and upper and lower bristle layers 27, 28.

Arrows 29, 30, and 31 in FIG. 1 illustrate generally the area of brush member 16 that tracks the gum ridge line of the child or infant. Thus, the distal end portion 13 will be sized to fit the child's upper and lower gums and teeth line so that the arrows 29, 30, and 31 are the approximate positions of the child's teeth and gums even if the child move the handle 14 from side to side or from front to rear slightly. This action of moving the handle 14 from side to side or back and forth causes the bristles 27, 28 to clean the child's teeth and to massage the child's gums during the teething years. This also teaches the child to be comfortable with the feel of the bristles so that the child is readily prepared to begin using a conventional toothbrush when he or she is older.

The following table lists the parts numbers and parts descriptions as used herein and in the drawings attached hereto.

PARTS LIST

| Part Number | Description |
|---|---|
| 10 | gum and toothbrush |
| 11 | body |
| 12 | proximal end |
| 13 | distal end |
| 14 | handle |
| 15 | guard |
| 16 | brush |
| 17 | hemispherical surface |
| 18 | flat annular shoulder |
| 19 | cylindrical section |
| 20 | edge |
| 21 | circular flange section |
| 22 | circular flange section |
| 23 | concave surface |
| 24 | concave surface |
| 25 | convex surface |
| 26 | convex surface |
| 27 | upper layer bristles |
| 28 | lower layer bristles |
| 29 | arrow |
| 30 | arrow |
| 31 | arrow |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A gum and tooth brush for an infant or small child comprising:

a) a body having a longitudinal axis, proximal end, and a distal end;

b) the body proximal end having a handle that can be gripped and manipulated by the infant;

c) the body including an enlarged guard that is positioned in between the proximal and distal ends, the guard having a transverse width and a vertical height;

d) a generally oval shaped planar brush member attached to the body, the brush member extending longitudinally away from the handle along the longitudinal axis to a free end portion and transversely with respect to the longitudinal axis, the brush member providing a peripheral portion that generally tracks the gum ridge line of the infant's mouth;

e) the brush member having an upper layer of bristles that faces the infant's upper gum and a lower layer of bristles that faces the infant's lower gum, and the combination of the layers being of a thickness that is substantially smaller than the height of the guard;

f) wherein the guard includes a concavity that prevents injury to the infant registering against the infant's lips and adjacent face area to limit the distance that the distal end can enter the infant's mouth, preventing insertion of the entire body into the infant's throat and mouth cavity; and g) wherein the concavity aligns the bristles with the infant's gum ridge line when the concavity abuts the infant's lips.

2. The gum and toothbrush apparatus of claim 1 wherein the bristles present a generally flat surface to the infant's upper gum.

3. The gum and toothbrush apparatus of claim 1 wherein the lower bristles present a generally flat surface to the infant's lower gum.

4. The gum and toothbrush apparatus of claim 1 wherein the guard is sized and shaped to cover the infant's lips and adjacent facial area so that the guard will not fit into the child's mouth.

5. The gum and toothbrush apparatus of claim 4 wherein the enlarged guard has a transverse width that is at least 5.2 mm.

6. The gum and toothbrush apparatus of claim 4 wherein the enlarged guard has a vertical maximum height of at least 3.5 mm.

7. The gum and toothbrush apparatus of claim 1 wherein the brush member has opposed curved peripheral portions that vary in distance apart, so that the brush member has a first smaller width section where the brush member joins the guard, a second smaller width section at the free end, and a middle section of the brush member that defines maximum width of the brush member.

8. The gum and toothbrush apparatus of claim 1 wherein the distal end portion is generally oval in shape.

9. The gum and toothbrush apparatus of claim 1 wherein the handle is rounded and of a general uniform circular shape, providing a circular periphery that can be gripped by a user.

10. A gum and tooth brush for an infant or small child comprising:

a) a body having a longitudinal axis, a proximal end, and a distal end;

b) the body proximal end having a handle that can be gripped and manipulated by the infant;

c) the body including an enlarged guard that is positioned in between the proximal and distal ends;

d) a planar brush member attached to the body that extends longitudinally and transversely to provide a peripheral portion that generally tracks the gum ridge line of the infant's mouth;

e) the brush member having an upper layer of bristles that faces the infant's upper gum and a lower layer of bristles that faces the infant's lower gum;

f) wherein the guard includes a concavity that prevents injury to the infant registering against the infant's lips and adjacent face area to limit the distance that the distal end portion can enter the infant's mouth, preventing insertion of the entire body into the infant's throat and mouth cavity; and g) wherein the concavity aligns the bristles with the infant's gum ridge line when the concavity abuts the infant's lips;

h) an annular recess positioned in between the handle and the guard.

11. The gum and toothbrush apparatus of claim 10 wherein the brush member has a generally oval shape.

12. A gum and tooth brush for an infant or small child comprising:

a) body having a longitudinal axis, a proximal ends, and a distal end;

b) the body proximal end having a handle that can be gripped and manipulated by the infant;

c) the body including an enlarged guard that is positioned in between the proximal and distal ends;

d) a generally oval shaped planar brush member that extends longitudinally and transversely to provide a peripheral portion that generally tracks the gum ridge line of the infant's mouth;

e) the brush member having an upper layer of bristles that faces the infant's upper gum and a lower layer of bristles that faces the infant's lower gum;

f) wherein the planar brush member has opposed generally flat surfaces that are parallel to one another and wherein the upper and lower layers of bristles are generally perpendicularly positioned with respect to the upper and lower flat surface of the planar brush member; and g) wherein the guard includes a concavity that prevents injury to the infant registering against the infant's lips and adjacent face area to limit the distance that the distal end portion can enter the infant's mouth, preventing insertion of the entire body into the infant's throat and mouth cavity.

* * * * *